US006657924B2

(12) United States Patent
McCravy

(10) Patent No.: US 6,657,924 B2
(45) Date of Patent: Dec. 2, 2003

(54) WALL HANGING BILL AND ORGANIZER CALENDAR

(76) Inventor: Kim S. McCravy, 798 Unity Church Cir., Maysville, GA (US) 30558

( * ) Notice: Subject to any disclaimer, the term of this patent is extended or adjusted under 35 U.S.C. 154(b) by 419 days.

(21) Appl. No.: 09/814,610

(22) Filed: Mar. 22, 2001

(65) Prior Publication Data

US 2001/0036127 A1 Nov. 1, 2001

Related U.S. Application Data

(60) Provisional application No. 60/191,514, filed on Mar. 23, 2000.

(51) Int. Cl.[7] ..... G04B 19/24; G04B 45/00; G09D 3/00

(52) U.S. Cl. ..... 368/28; 368/41; 40/107

(58) Field of Search ..... 368/10, 28, 29, 368/41, 43, 82, 84, 223; 40/107, 119–122; 116/306–308

(56) References Cited

U.S. PATENT DOCUMENTS

| | | | | | |
|---|---|---|---|---|---|
| 3,696,532 | A | | 10/1972 | Nahon | 35/62 |
| 3,782,009 | A | * | 1/1974 | Darnell | 35/23 R |
| 4,314,418 | A | | 2/1982 | Narens et al. | 40/358 |
| 4,611,265 | A | | 9/1986 | Davis | 362/145 |
| 4,630,934 | A | * | 12/1986 | Arber | 368/28 |
| 4,703,571 | A | | 11/1987 | McCarthy | 40/107 |
| 4,708,490 | A | * | 11/1987 | Arber | 368/28 |
| 4,815,225 | A | | 3/1989 | Wilen | 40/119 |
| 4,850,124 | A | | 7/1989 | Wilen | 40/122 |
| 4,858,350 | A | | 8/1989 | Malarchik | 40/119 |
| 4,868,800 | A | * | 9/1989 | Arber | 368/29 |
| 4,905,388 | A | * | 3/1990 | Sinkow | 40/110 |
| 5,033,215 | A | | 7/1991 | Newberry et al. | 40/107 |
| 5,214,869 | A | | 6/1993 | Wilen | 40/122 |
| 5,339,546 | A | | 8/1994 | Rahwam | 40/107 |
| 5,412,886 | A | | 5/1995 | Quinn | 40/119 |
| 5,797,204 | A | | 8/1998 | Paulos | 40/122 |
| 6,469,958 | B1 | * | 10/2002 | Bray | 368/28 |

* cited by examiner

*Primary Examiner*—Vit Miska
(74) *Attorney, Agent, or Firm*—Thomas, Kayden, Horstemeyer & Risley

(57) ABSTRACT

This disclosure provides an organizational calendar and an organizational apparatus and methods of using each. The organizational calendar includes a substantially planar sheet of material that has a plurality of item containers disposed upon the material. In addition, the organizational calendar includes a plurality of time period indicators. Each of the time period indicators includes an item container. Further, the organizational calendar includes a notice indicator located substantially near at least one of the time period indicators. Furthermore, the organizational calendar includes a current time period indicator, which is located substantially near at least one of the time period indicators.

31 Claims, 4 Drawing Sheets

WALL HANGING BILL AND ORGANIZER CALENDAR

CROSS-REFERENCE TO RELATED APPLICATIONS

This application is related to copending U.S. Provisional patent application entitled "Wall Hanging Bill and Appointment Organizer" filed on Mar. 23, 2000 and accorded Ser. No. 60/191,514, which is entirely incorporated herein by reference and U.S. Design patent Application entitled "Wall Hanging Bill and Appointment Organizer", filed on even day herewith, which is entirely incorporated herein by reference.

TECHNICAL FIELD

The present invention is generally related to organizers and calendars and, more particularly, is related to a calendar apparatus that functions as an organizer.

BACKGROUND OF THE INVENTION

Calendar organizers have been known for some time. These calendar organizers generally have a large backing board with a front sheet attached thereto, with pockets formed between the front sheet and the back sheet. Indicia or markings are printed on the calendar organizer to identify dates associated with each of the pockets.

However, these previous calendar organizers have deficiencies which have prevented them from being widely used. In particular, the pockets on previous calendar organizers may have an opening size which limits the size of the items retainable in the pockets. Several concepts have been tried to enable the calendar organizers to receive larger items within the pockets. For instance, the pockets on some previous calendar organizers have been enlarged to cover two or more days on the calendar. While each pocket may be larger, a single multiple day pocket no longer distinguishes between the two or more days which it covers. Alternatively, the front sheet portion of the pocket on some previous calendar organizers may be dimensionally larger than the back sheet portion, so the pocket can expand further outward from the back sheet. The construction of these calendar organizers is somewhat time consuming and difficult, creating a more expensive product. A third way to increase pocket size is to increase the overall size of the entire calendar organizer. However, an excessively large calendar organizer is both expensive to construct and inconvenient to use and store.

Additional problems exist with previous calendar organizers. The pockets on many previous calendar organizers are not constructed for easy insertion and removal of documents. Some previous calendar organizers use specially-made reminder cards or inserts which are intended only for use with the calendar organizer. While the specially-made cards may be easily received in the pockets, other problems arise. Construction of the specially-made cards is time-consuming for the user or expensive for the manufacturer, and a limited number of pre-made cards cannot cover the myriad of possible items which may be associated with each day of the calendar.

Thus, a heretofore unaddressed need exists in the industry to address the aforementioned deficiencies and inadequacies.

SUMMARY OF THE INVENTION

An embodiment of the present invention provides an organizational calendar. The organizational calendar includes a substantially planar sheet of material that has a plurality of item containers disposed upon the material. In addition, the organizational calendar includes a plurality of time period indicators. Each of the time period indicators includes an item container. Further, the organizational calendar includes a notice indicator located substantially near at least one of the time period indicators. Furthermore, the organizational calendar includes a current time period indicator, which is located substantially near at least one of the time period indicators.

Another alternative embodiment provides for an organizational apparatus. The organizational apparatus includes a substantially planar sheet of material that has a plurality of item containers. In addition, the organizational apparatus includes a plurality of sign indicators, where each of the sign indicators includes an item container. Further, the organizational apparatus includes a notice indicator that is located substantially near at least one of the time period indicators. Furthermore, the organizational apparatus includes a sign alert indicator that is located substantially near at least one of the time period indicators.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

One of a number of embodiments of the present invention provides for a calendar organizer. The calendar organizer includes a substantially planar material that has a plurality of time period indicators and a plurality of item containers disposed thereon. There can also be one or more notice indicators and a current time indicator located substantially near at least one of the time period indicators. Substantially near is defined as near or upon. In addition, the calendar organizer may include an electronic system that is capable of communicatively coupling with one or more electronic devices. Further, the electronic system is capable of communicatively coupling with and actuating one or more of the following: time period indicators, notice indicators, current time indicators, etc. In addition, the electronic device is capable of communicatively coupling with and actuating one or more of the following: time period indicator, notice indicator, current time indicator, etc. The time period, notice, and current time indicators each include one or more light emitting diodes, liquid crystal displays, or other displays. The calendar organizer can hang on a wall or door, can attach to a metal surface using an attaching system (e.g. magnets, hooks, eye-lets, etc.), or can lie on a table or desk.

Another embodiment of the present invention provides an organizer apparatus. The organizer apparatus includes a substantially planar material that has a plurality of item containers and sign indicators thereon. Substantially near at least one of the item containers are one or more sign indicators, notice indicators, and sign alert indicators. In one embodiment the indicators can be actuated using an electronic system that is capable communicatively coupling with one or more electronic devices. In addition, the electronic device is capable of communicatively coupling with and actuating one or more of the following: time period indicator, notice indicator, current time indicator, etc. The indicators include one or more light emitting diodes, liquid crystal display or other displays which are able to communicatively couple with the electronic system. Also, in another embodiment the indicators can function using a non-electronic system, such as Velcro or tab system that enable stamps, stars, symbols, emblems, etc. to engage the organizer apparatus to be used as a sign, notice, or sign alert indicator. The organizer apparatus can hang on a wall or door, can attach to a metal surface using an attachment system (e.g. magnets), or can lie on a table or desk.

Figure 1A:
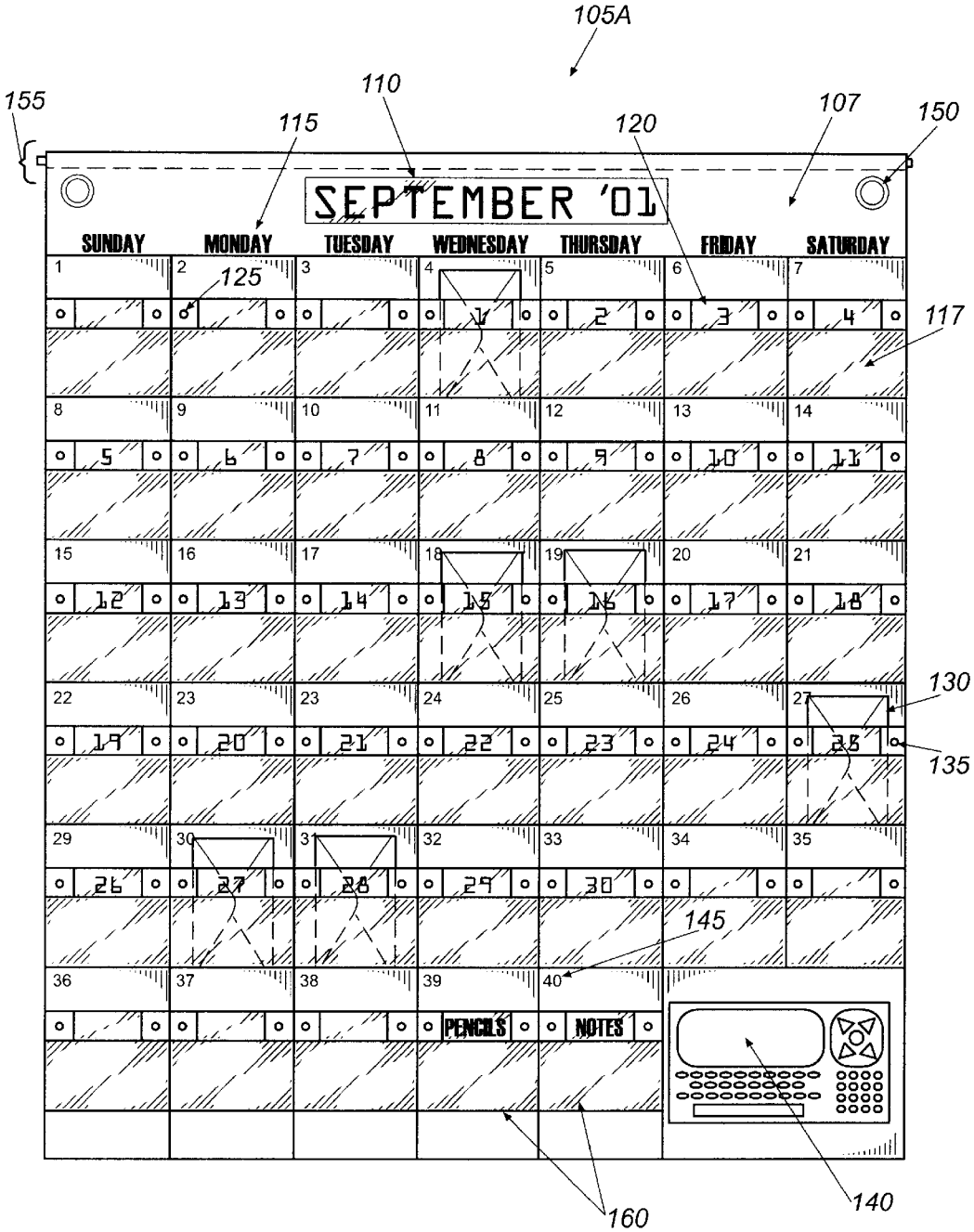
FIGS. 1A and 1B illustrate a front and side view on an embodiment of the present invention.
Figure 1B:
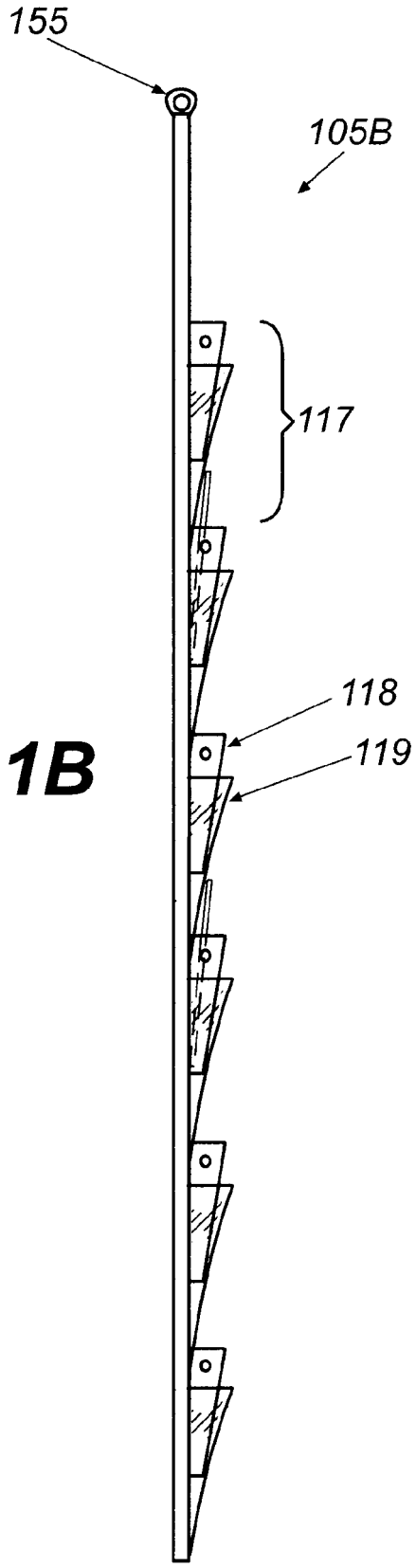

More specifically, FIGS. 1A and 1B illustrate a front and side view, respectively, of one of a number of possible embodiments of the present invention. FIG. 1A illustrates the front of one embodiment of the calendar organizer 105A with a time period of one month. Other calendar organizer embodiments may include time periods of one or more weeks, one or more months, or a year. In embodiments where appropriate, the days of the week 115 are displayed upon the calendar organizer 105A. The days of the week are generally located at the top or the bottom of the calendar organizer 105A. The calendar organizer can be constructed of a material 107 which includes, but is not limited to, canvas, cotton, plastic, or any other suitable material. The material 107 is substantially planar so that it can be hung on a wall or laid on a table. FIG. 1A illustrates a nonlimiting example of a monthly calendar and includes a plurality of time period indicators. These time period indicators include, but are not limited to, a year indicator(not shown), a month indicator 110, a day indicator 115, and time of day indicator (not shown), e.g. 1 PM or 8 AM. At least one time period indicator is associated with at least one item container 117 such as a bill or other item can be acted upon on the indicated time period (e.g. send a bill on a calendar date).

The item container 117 can be constructed as part of the calendar organizer 105A or can be a separate item that is capable of being attached to the calendar organizer 105A. The item container 117 can include one or more compartments 118 and 119, as shown in FIG. 1B. The item container 117 can be constructed of the same or different material as the calendar organizational material 107. The item container 117 can be constructed of canvas, cotton, plastic or any other suitable material. The item container 117 can be substantially square, substantially rectangular, or any other appropriate shape for receiving items such as envelopes, tickets, keys, etc. Generally, the item container 117 includes a plurality of item container surfaces that extend from the calendar organizational material 107, as can bee seen in FIG. 1B. The top-side of the item container 117 is substantially unattached to the calendar organizational material 107, while the bottom-side is substantially attached to the calendar organizational material 107. At least two adjacent sides of the item container surface are substantially attached to the calendar organizational material 107 so that items can be retained by the organizational calendar 105A. Nonlimiting illustrative examples of a substantially square item container include, but are not limited to, an item container where the bottom and left sides are attached to the calendar organizational material 107, an item container where the bottom and right sides are attached to the calendar organizational material 107, or an item container where the bottom, right, and left sides are attached to the organizational material 107.

Located substantially near or on the item container 117 is a day of the month indicator 120, at least one current time period indicator 125, and at least one notice indicator 135. Also, located substantially near or on the item container 117 is the item container number 145, which can be used to correspond to a specific item container 117, without the need of using the specific date of a month to coordinate with the item container 117. The day of the month indicator 120, current time period indicator 125, and notice indicator 135 include one or more displays. The displays include, but are not limited to, a light emitting diode, liquid crystal display, and the like. The day of the month indicator 120 displays the day of the month (e.g. $1^{st}$, $2^{nd}$, . . . $31^{st}$). The current time period indicator 125 illustrates that a particular day is the current day of the month. An example of a current time period indicator 125 would include, but is not limited to, an illuminated light emitting diode substantially near or upon an item container 117, while other light emitting diodes associated with other days are not illuminated. The notice indicator 135 indicates that a bill 130 or other item needs to be acted upon, that there is an appointment on that day, or the like. An example would include, but is not limited to, an illuminated light emitting diode substantially near or upon an item container 117, while other light emitting diodes of the other notice indicators 135 associated with other item containers 117 are not illuminated.

In a preferred embodiment, the calendar organizer 105A includes an electronic system (not shown) that is capable of communicatively coupling with an electronic device 140. The electronic system may include, but is not limited to, a computer system, battery system, adapters for various types of electronic devices, electronic outlets/inlets, telephone/cable connections, a display as discussed above, etc. The electronic system is capable of communicatively coupling with at least the month indicator, the day of the month indicator 120, the current time period indicator 125, and the notice indicator 135. The electronic system is capable of controlling the message displayed on the various indicators, such as the year, month, day of month, etc. In addition, the electronic system is capable of actuating the light emitting diodes, liquid crystal displays, etc. associated with each of the indicators. Further, the electronic system is capable of actuating an audible sound that is associated with each of the indicators. The audible sound may be a pre-programmed sound or programmed sound created by the user. The electronic device 140 is capable of actuating at a pre-programmed time to conserve energy. The electronic system is capable of actuating at a pre-programmed time to conserve energy by actuating the electronic system.

The electronic devices 140 that can be used include, but are not limited to, a keypad, a calculator rolodeck, a personal organizer, a personal data assistant, a wireless device, a microprocessor, a personal computer, etc. The electronic device 140 is capable of communicatively coupling with the month indicator, the day of the month indicator 120, the current time period indicator 125, and the notice indicator 135 via the electronic system. Like the electronic system, the electronic device 140 is capable of controlling the message displayed on the various indicators, such as the year, month, day of month, etc. In addition, the electronic device 140 is capable of actuating the light emitting diodes, liquid crystal displays, etc. associated with each of the indicators. Further, the electronic device 140 is capable of actuating an audible sound associated with each of the indicators. The audible sound may be a pre-programmed sound or programmed sound created by the user. The electronic device 140 is capable of actuating at a pre-programmed time to conserve energy.

The calendar organizer 105A can be attached to a wall or door by hanging the calendar organizer 105A using an eyehole 150 or other appropriate hanging mechanism such as rope, chord, string, wire, or the like. In addition, a rod 155 may be inserted into a sleeve at the top and/or bottom of the calendar organizer 105A to support the calendar organizer 105A.

Item containers 160 that do not correspond to a day of a month can be used to hold pencils, note cards, current time indicator emblems, notice indicator emblems, electronic devices, etc.

In another embodiment, the calendar organizer 105B includes a non-electric system that indicates month indicators, day of the month indicators, current the period indicators 125, and notice indicators 135. The non-electric system includes tabs or cards for attaching or placing onto the organizational apparatus to indicate each indicator. The indicators can be attached to the organizational apparatus using an attachment system that includes, but is not limited to, one or more of the following: a Velcro system, hook and loop system, button system, snap system, color card, etc. The organizational apparatus includes slots to slide the cards into. The slots can be made of a clear plastic material or other appropriate material such that the message of the card is indicated to the observer. The organizational calendar 105 further includes pre-manufactured cards with labels, such as but not limited to, pencils, stars, stamps, etc. The organizational calendar 105 can also include unlabeled cards that can be labeled appropriately with names, etc.

FIG. 1B illustrates a side view of the calendar organizer 105B. The side view of the calendar organizer 105B illustrates that the calendar organizer 105B is substantially planar. The side view further illustrates that the item containers 117 extend slightly out from the calendar organizer 105B and are capable of holding a letter 130 or other item. Further, the item container 117 can include two compartments 118 and 119, where one compartment 118 can hold a letter 130, while the other compartment 119 can hold some other item or sign. The item container 117 can be any appropriate size or shape as indicated hereinabove.

Figure 2:
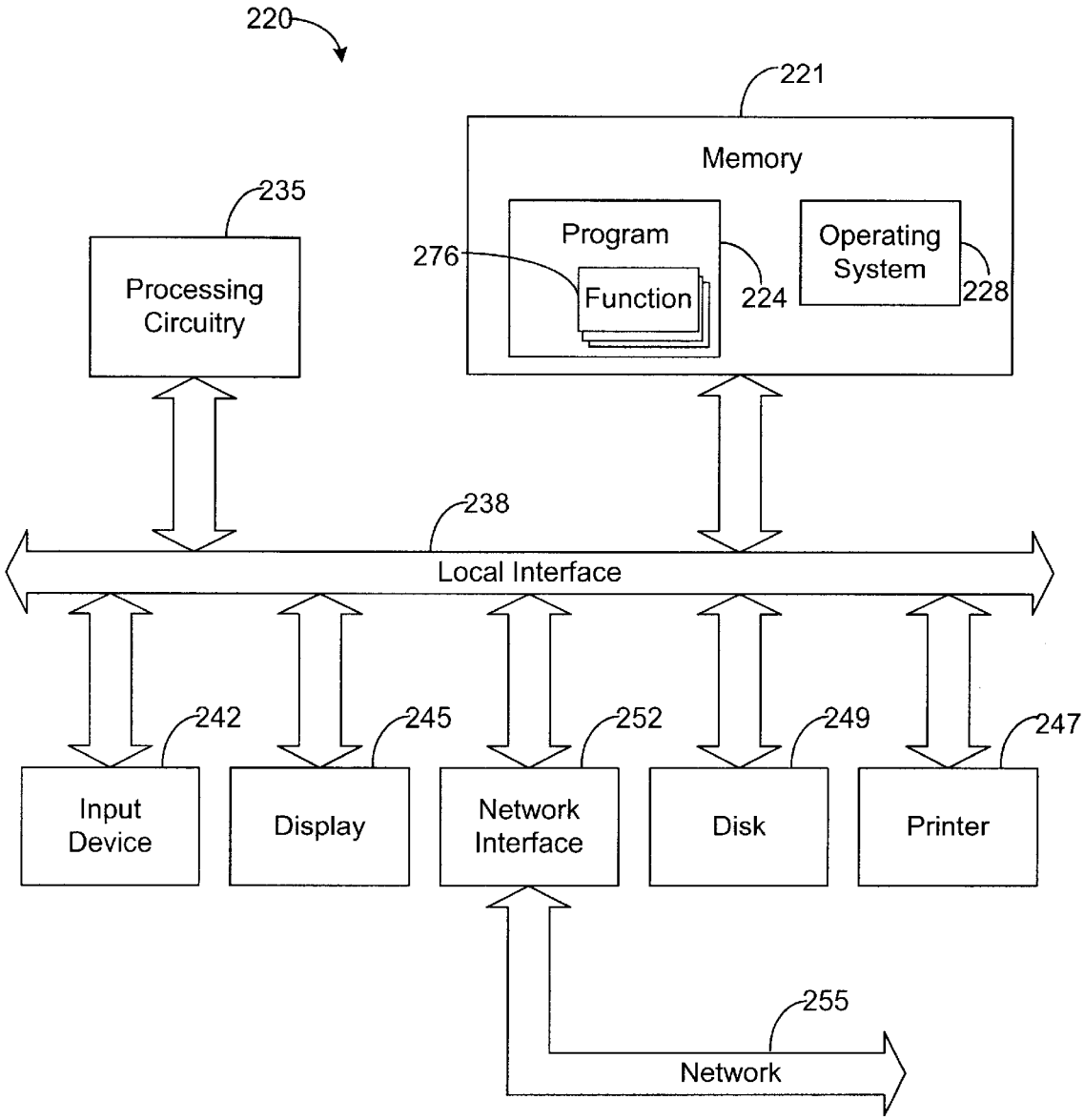
FIG. 2 illustrates a computer system that can be incorporated into an embodiment of the present invention, as shown in FIGS. 1A and 1B.

The calendar organizer 105 can include an electronic system 140 that may further include a computer system 220 as described in FIG. 2. The computer system 220 includes memory 221 for storing and retrieving data. Similar to conventional memory systems, the memory 221 depicted by FIG. 2 includes various locations for storing data, and each of these locations is identified by an address. In the embodiment depicted by FIG. 2, a program 224 and an operating system 228 are stored in the computer memory 221. The computer system 220 of FIG. 2 also includes processing circuitry 235, such as a general purpose microprocessor, for example, that communicates to and drives the other elements within the system 220 via a local interface 238, which can include one or more buses. Furthermore, an input device 242, for example, a keyboard, mouse, bar code scanner, etc., can be used to input data from a user of the system 220, and a screen display 245 or a printer 247 can be used to output data to the user. A disk storage mechanism 249 can be connected to the local interface 238 to transfer data to and from a nonvolatile disk (e.g., magnetic, optical, etc.). The system 220 can be connected to a network interface 252 that allows the system 220 to exchange data with a network 255.

The program 224 includes instructions or computer code written by a programmer for performing various functions 276 with regard to the calendar organizer 105. Programmers often choose to write programs, such as the program 224, in a high level computer language such as, but not limited to, C or Fortran, for example. The program 224 is in a form compatible with processing circuitry 235 and, therefore, can be executed by processing circuitry 235. The operating system 228, similar to conventional operating systems, is designed to control the operation of the computer system 220. An important service performed by the operating system 228 is the interfacing of executable instructions with the processing circuitry 235. In this regard, the operating system 228 controls which instructions stored in memory 221 are transmitted to the processing circuitry 235 for execution and controls when these instructions are transmitted to the processing circuitry 235. The program 224 and the operating system 228 can be implemented in software, hardware, or a combination thereof. In the preferred embodiment, as illustrated by way of example in FIG. 2, the program 224 and the operating system 228 along with their associated methodology are implemented in software and stored in memory 221. The program 224 can be a source program that is compiled to form an executable program.

Note that the program 224 and the operating system 228, when implemented in software, can be stored and transported on any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can contain, store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection (electronic) having one or more wires, a portable computer diskette (magnetic), a random access memory (RAM) (magnetic), a read-only memory (ROM) (magnetic), an erasable programmable read-only memory (EPROM or Flash memory) (magnetic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

Figure 3:
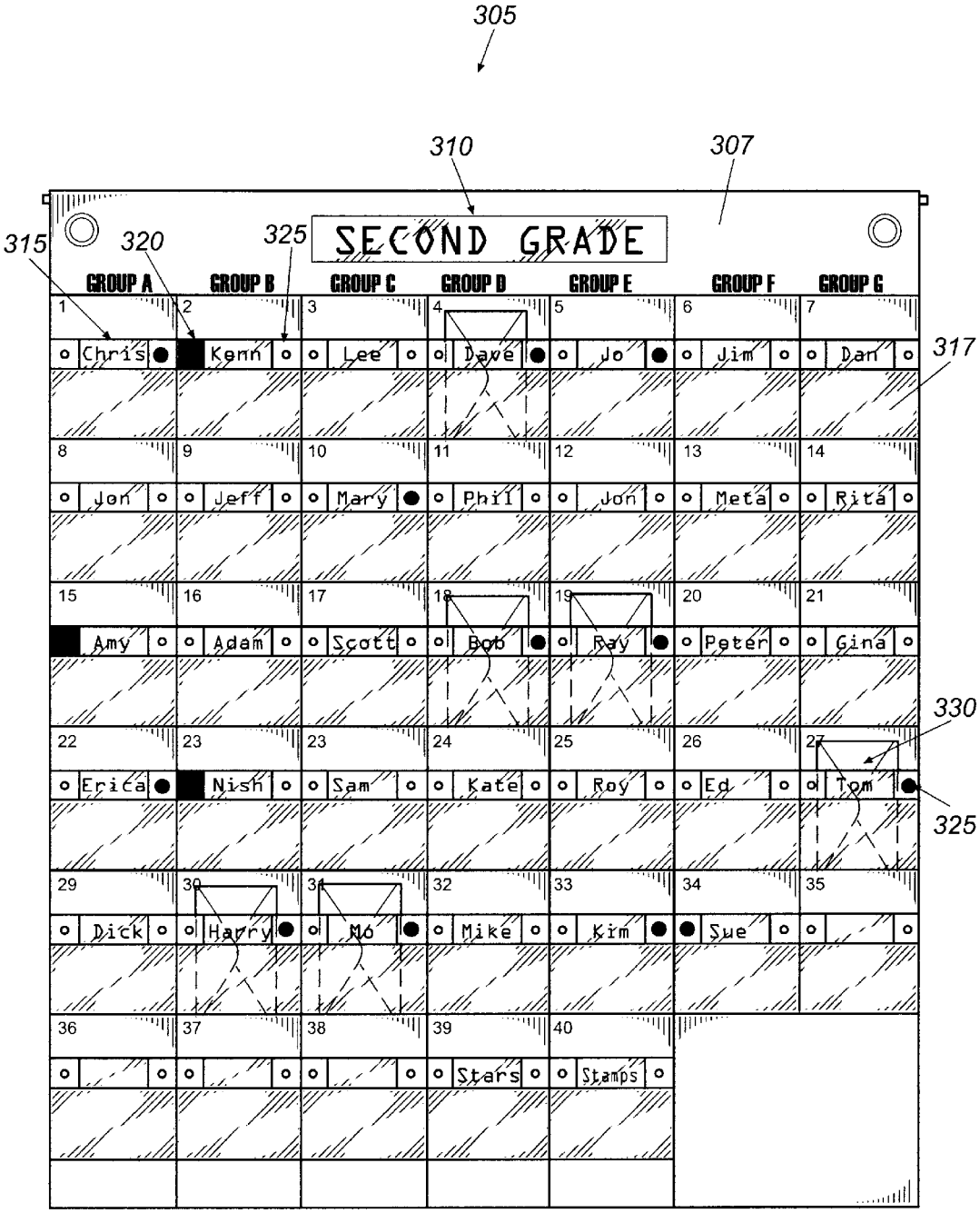
FIG. 3 illustrates a front view of another embodiment of the present invention.

FIG. 3 illustrates another embodiment of the present invention 305. FIG. 3 illustrates a substantially planar organizational apparatus 305 that can be used in an office or classroom setting. The organizational apparatus 305 includes a plurality of sign indicators 310 and 315, sign alert indicators 320, and notice indicators 325. One sign indicator, the heading sign indicator 310, is typically located at the top of the organizational apparatus 305 and can display a grade name, group name, etc. Then substantially near or upon one or more item indicators 317, another sign indicator, the name indicator 315, indicates that the item container 317 corresponds with a specific person or group. Both of these sign indicators can indicate a name, grade, etc. that is appropriate for the situation. For example and as illustrated in FIG. 3, the heading indicator 310 illustrates that this organizational apparatus 305 is for the "Second Grade", while the name indicators 315 indicate that the children are in that second grade class. Likewise, this organizational apparatus 305 can be used in an office or professional type setting.

The organizational apparatus 305 includes an item container 317 that can be constructed as part of the organizational material 307 or can be constructed by using a separate item that is capable of being attached to the organizational apparatus 305 and upon attachment creates an item container 317. The item container 317 can be constructed of the same or different material as the calendar organizational material 307. The item container 317 can be constructed of canvas, cotton, plastic or any other suitable material. The item container 317 can be substantially square, substantially rectangular, or any other appropriate shape for receiving items such as envelopes, tickets, keys, etc. Generally, the item container 317 includes a plurality of item container surfaces that extend from the organizational material 307. The top-side of the item container 317 is not substantially attached to the organizational material 307, while the bottom-side is substantially attached to the organizational material 307. At least two adjacent sides of the item container surface are attached to the organizational material 307. Non-limiting illustrative examples of a substantially square item container include, but are not limited to, an item container where the bottom and left sides are attached to the organizational material 307, an item container where the bottom and right sides are attached to the calendar organizational material 307, or an item container where the bottom, right, and left sides are attached to the organizational material 307.

Located substantially near or on the item container 317 is at least one sign alert indicator 320 and at least one notice indicator 325. The sign alert indicator 320 can indicate, for example, that the person is not in that day, that a student has not turned in their homework, etc. The sign alert indicator 320 can indicate anything that is appropriate for the particular application. The notice indicator 325 indicates, for example, that a student has a doctors appointment 330 on that day. Just as with the sign alert indicator, the notice indicator 325 can indicate anything that is appropriate for the particular application.

In one embodiment, the organizational apparatus 305 includes a non-electric system for indicating sign indicators 310 and 315, sign alert indicators 320, and notice indicators 325. The non-electric system includes tabs or cards of the various indicator for attaching or placing onto the organizational apparatus 305. The indicators 310, 315, 320, and 325 can be attached to the organizational apparatus 305 using an attachment system that includes, but is not limited to, one or more of the following: a Velcro system, hook and loop system, button system, snap system, etc. The organizational apparatus 305 includes slots to slide the cards into. The slots can be made of a clear plastic material or other appropriate material such that the cards can be read by an observer. The organizational apparatus 305 further includes pre-manufactured cards with labels, such as but not limited to, pencils, stars, stamps, etc. The organizational apparatus 305 can also include unlabeled cards that can be labeled appropriately with names, etc.

In another embodiment, the organizational apparatus 305 includes an electronic system (not shown) that is capable of communicatively coupling with an electronic device (not shown). The electronic system may include, but is not limited to, a computer system 220, battery system, adapters for various types of electronic devices, electronic outlets/inlets, displays, etc. The electronic system is capable of communicatively coupling with the sign indicators 310 and 315, sign alert indicators 320, and the notice indicators 335. The sign indicator 310, sign alert indicators 320, and notice indicators 335 include one or more displays. The displays include, but are not limited to, a light emitting diode, liquid crystal display and the like. The electronic system is capable of controlling the message displayed on the various indicators, such as the name, association, etc. In addition, the electronic system is capable of actuating the light emitting diodes, liquid crystal displays, etc. associated with each of the indicators. Further, the electronic system is capable of actuating an audible sound that is associated with each of the indicators. The audible sound may be pre-programmed or programmed by the user. The electronic system is capable of actuating at a pre-programmed time to conserve energy by actuating the electronic system.

The electronic devices that can be used include, but are not limited to, a keypad, a calculator rolodeck, a personal organizer, a wireless device, a computer, etc. The electronic device is capable of communicatively coupling with the sign indicators 310 and 315, sign alert indicators 320, and the notice indicators 335. Like the electronic system, the electronic device is capable of controlling the message displayed on the various indicators, such as the name, item, etc. In addition, the electronic device is capable of actuating a light emitting diode, liquid crystal display, etc. associated with each of the indicators. Further, the electronic device is capable of actuating an audible sound that is associated with each of the indicators. The audible sound may be pre-programmed or programmed by the user. The electronic device is capable of actuating at a pre-programmed time to conserve energy by actuating the electronic system.

The computer system 220 described in FIG. 2 is representative of the computer system 220 that would be used in the embodiment of organizational apparatus 305 that includes an electronic system.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A organizational calendar comprising:

a means for retaining an item;

a means for indicating a plurality of time periods, wherein said each time period means includes a means for retaining an item;

a means for indicating a current time period located substantially near the means for indicating a plurality of time periods; and a means for indicating a notice located substantially near the means for indicating a plurality of time periods.

2. The organizational calendar of claim 1, wherein the means for indicating a time period includes a means for indicating a month.

3. The organizational calendar of claim 1, wherein the means for indicating a time period includes a means for indicating a weekday.

4. A method of using an organizational calendar comprising:

retaining an item with an item container;

indicating a plurality of time periods with a plurality of time period indicators, wherein said each time period indicator includes retaining an item with a item container;

indicating a current time period with a current timer period indicator that is located substantially near the plurality of time period indicators; and indicating a notice with a notice indicator that is located substantially near the plurality of time period indicators.

5. An organizational calendar comprising:

a substantially planar sheet of material;

a plurality of item containers disposed upon the material;

a plurality of time period indicators, each of the time period indicators having an item container;

an notice indicator located substantially near at least one of the time period indicators; and a current time period indicator located substantially near at least one of the time period indicators.

6. The organizational calendar of claim 5, wherein the time period includes a month indicator.

7. The organizational calendar of claim 5, wherein the time period includes a weekday indicator.

8. The organizational calendar of claim 5 further comprising, an electronic system that is capable of communicatively coupling with an electronic device.

9. The organizational calendar of claim 8, wherein the electronic system is communicatively coupled to the time period indicator.

10. The organizational calendar of claim 9, wherein the time period indicator further includes a light emitting diode.

11. The organizational calendar of claim 10, wherein the time period includes a month indicator.

12. The organizational calendar of claim 10, wherein the time period includes a weekday indicator.

13. The organizational calendar of claim 8, wherein the electronic system is communicatively coupled to the notice indicator.

14. The organizational calendar of claim 13, wherein the notice indicator further includes a light emitting diode.

15. The organizational calendar of claim 8, wherein the electronic system is communicatively coupled to the current time period indicator.

16. The organizational calendar of claim 15, wherein the current time period indicator further includes a light emitting diode.

17. A organizational apparatus comprising:

a means for retaining an item;

a means for indicating a plurality of signs, wherein said each sign means includes a means for retaining an item;

a means for indicating a sign alert is located substantially near the means for indicating a plurality of signs; and a means for indicating a notice located substantially near the means for indicating a plurality of signs.

18. The organizational apparatus of claim 17, wherein the means for indicating a sign includes a means for indicating a name.

19. An organizational apparatus comprising:

a substantially planar sheet of material;

a plurality of item containers disposed upon the material;

a plurality of sign indicators, each of the sign indicators having an item container;

an notice indicator located substantially near at least one of the sign indicators; and a sign alert indicator located substantially near at least one of the sign indicators.

20. The organizational apparatus of claim 19, wherein the sign includes a name indicator.

21. The organizational apparatus of claim 19 further comprising, an electronic system that is capable of communicatively coupling with an electronic device.

22. The organizational apparatus of claim 21, wherein the electronic system is communicatively coupled to the sign indicator.

23. The organizational apparatus of claim 22, wherein the sign indicator further includes a light emitting diode.

24. The organizational apparatus of claim 21, wherein the electronic system is communicatively coupled to the notice indicator.

25. The organizational apparatus of claim 24, wherein the notice indicator further includes a light emitting diode.

26. The organizational apparatus of claim 21, wherein the electronic system is communicatively coupled to the sign alert indicator.

27. The organizational apparatus of claim 26, wherein the sign alert indicator further includes a light emitting diode.

28. The organizational apparatus of claim 19, wherein the sign indicator is capable of being engaged to the material using an attachment system.

29. The organizational apparatus of claim 19, wherein the notice indicator is capable of being engaged to the material using an attachment system.

30. The organizational apparatus of claim 19, wherein the sign alert indicator is capable of being engaged to the material using an attachment system.

31. A method of using an organizational apparatus, comprising the steps of:

retaining an item with an item container;

indicating a plurality of signs with a sign indicator, wherein said each sign indicator includes retaining an item with an item container;

indicating a sign alert with a sign alert indicator which is located substantially near the plurality of sign indicators; and indicating a notice with a notice indicator which is located substantially near the plurality of sign indicators.

* * * * *